United States Patent [19]

Yamanaka et al.

[11] Patent Number: 4,537,743

[45] Date of Patent: Aug. 27, 1985

[54] ELECTRODE COMPOSITION FOR VACUUM SWITCH

[75] Inventors: Takashi Yamanaka, Itami; Yasushi Takeya, Osaka; Mitsumasa Yorita, Itami; Toshiaki Horiuchi, Settsu; Kouichi Inagaki, Itami; Eizo Naya, Ibaraki; Michinosuke Demizu, Takarazuka; Mitsuhiro Okumura, Sakai, all of Japan

[73] Assignee: Mitsubishi Denki Kabushiki Kaisha, Tokyo, Japan

[21] Appl. No.: 624,519

[22] Filed: Jun. 25, 1984

Related U.S. Application Data

[62] Division of Ser. No. 451,324, Dec. 20, 1982, Pat. No. 4,499,009.

[30] Foreign Application Priority Data

Dec. 21, 1981 [JP] Japan ..... 56-208687

[51] Int. Cl.[3] ..... B22F 1/04

[52] U.S. Cl. ..... 419/38; 419/39; 419/46; 419/58; 29/622; 29/756; 29/879; 252/512; 252/513; 252/515; 200/265; 200/266; 264/61; 264/65; 420/469; 420/470; 420/474

[58] Field of Search ..... 252/512, 513, 515; 75/134 C, 153, 154, 155; 200/144 R, 144 B, 266, 265; 29/622, 749, 875, 756, 879; 419/56, 58, 38, 46, 54; 264/65, 61; 420/469, 470, 474

[56] References Cited

U.S. PATENT DOCUMENTS

| | | | |
|---|---|---|---|
| 2,975,255 | 3/1961 | Lafferty | 200/144 |
| 3,922,236 | 11/1975 | Douglas et al. | 252/512 |
| 3,951,872 | 4/1976 | Neeley | 252/513 |
| 3,962,487 | 6/1976 | Fuller et al. | 252/512 |
| 3,963,633 | 6/1976 | Fein et al. | 252/512 |
| 3,985,512 | 10/1976 | Hässler et al. | 252/512 |
| 3,993,481 | 11/1976 | Schreiner et al. | 252/513 |
| 4,002,940 | 1/1977 | Ekkelboom et al. | 252/512 |
| 4,172,919 | 10/1979 | Mitchell | 252/512 |

*Primary Examiner*—J. L. Barr

*Attorney, Agent, or Firm*—Wenderoth, Lind & Ponack

[57] ABSTRACT

The disclosed electrode composition for a vacuum switch comprises copper, as a principal ingredient, a low melting point metal such as Bi, Pb, In, Li, Sn or any of their alloys, in a content not exceeding 20% by weight, a first additional metal such as Te, Sb, La, Mg or any of their alloys and a refractory metal such as Cr, Fe, Co, Ni, Ti, W or any of their alloys in a content less than 40% by weight.

2 Claims, 2 Drawing Figures

ELECTRODE COMPOSITION FOR VACUUM SWITCH

This is a divisional application of Ser. No. 451,324, filed Dec. 20, 1982, now U.S. Pat. No. 4,499,009.

BACKGROUND OF THE INVENTION

This invention relates to a vacuum switch which is required to have a low chopping current characteristic, and more particularly to an electrode composition for such a vacuum switch composed of an alloy including copper (Cu) and a low melting point metal such as bismuth (Bi), lead (Pb), indium (In) or the like.

Conventional electrode compositions of the type referred to have involved cupper-bismuth (Cu-Bi) alloys, copper-lead (Cu-Pb) alloys, copper-cobalt-bismuth (Cu-Co-Bi) alloys, cupper-chromium-bismuth (Cu-Cr-Bi) alloys etc. When the low chopping current characteristic is not required, emphasis is placed on properties other than the low chopping current characteristic, by controlling the content of a low melting point metal such as bismuth or the like to about 1% by weight. On the other hand, where the low chopping current characteristic is required to be not higher than one ampere, the particular electrode composition includes a low melting point metal such as bismuth or the like in a large amount on the order of from 10 to 20% by weight. At that time, one or more of cobalt (Co), chromium (Cr), nickel (Ni), titanium (Ti), tungsten (W), iron (Fe) etc. has or have been added to the electrode composition for the purpose of improving the withstanding voltage characteristic. However the low melting point metal such as bismuth, lead, indium or the like scarcely forms a solid solution with copper at room temperature and is precipitated into a metallographic structure having a low melting point metal aggregated at the grain boundary of copper. This has resulted in disadvantages such that, upon interrupting a high current, a vapor of the low melting point metal is evolved in a large amount to sharply reduce the interrupting characteristic while the low melting point metal precipitated at the copper grain boundary greatly deteriorates the mechanical strength of the alloy.

Also upon brazing the electrode alloy to an associated electrode rod at a temperature of from 700° to 800° C., the low melting point metal intrudes in the junction of the alloy and the rod to greatly decrease the strength of the junction. Also when the electrode alloy brazed to the electrode rod is assembled into an envelope followed by the degasing and evacuating of the envelope at from 400° to 600° C., the low melting point metal is vaporized and scattered to contaminate the inner surface of the envelope. This has resulted in the disadvantage that the withstanding voltage characteristic is reduced and so on.

Further more each time the resulting vacuum switch is operated to open or close a load current flowing therethrough, the surface of the contact formed of the electrode alloy becomes slowly enriched with copper attended with the fatal disadvantage that the chopping current of the switch rises.

Accordingly it is an object of the present invention to provide a new and improved electrode composition for a vacuum switch improved in interrupting characteristic, withstanding voltage characteristic and/or brazing characteristic while maintaining the chopping characteristic stable and low with an indefinite number of the switching operations performed by a vacuum switch including a pair of contacts formed of such an electrode composition.

SUMMARY OF THE INVENTION

The present invention provides an electrode composition for a vacuum switch comprising copper (Cu) as a principal ingredient, a low melting point metal in a content not exceeding 20% by weight, the low melting point metal scarcely forming a solid solution with the copper at room temperature, and a first additional metal in a content not exceeding 10% by weight, the first additional metal forming an alloy with the low melting point at a temperature not less than a melting point of the low melting point metal and being alloyable with the copper at a temperature not higher than a melting point of the alloy.

In order to improve the withstanding voltage and interrupting characteristics of the vacuum switch, the electrode composition may comprise a second additional metal consisting of a refractory metal in a content less than 40% by weight, and having a melting point higher than that of the copper.

The low melting point metal may comprises at least one selected from the group consisting of bismuth (Bi), lead (Pb), indium (In), lithium (Li), tin (Sn) and alloys thereof. The first additional metal may comprise at least one selected from the group consisting of tellurium (Te), antimony (Sb), lanthanum (La), magnesium (Mg) and alloys thereof. The refractory metal may comprise at least one selected from the group consisting of chromium (Cr), iron (Fe), cobalt (Co), nickel (Ni), titanium (Ti), tungsten (W) and alloys thereof.

BRIEF DESCRIPTION OF THE DRAWING

The present invention will become more readily apparent from the following detailed description taken in conjunction with the accompanying drawing in which.

DESCRIPTION OF THE PREFERRED EMBODIMENTS

Figure 1:
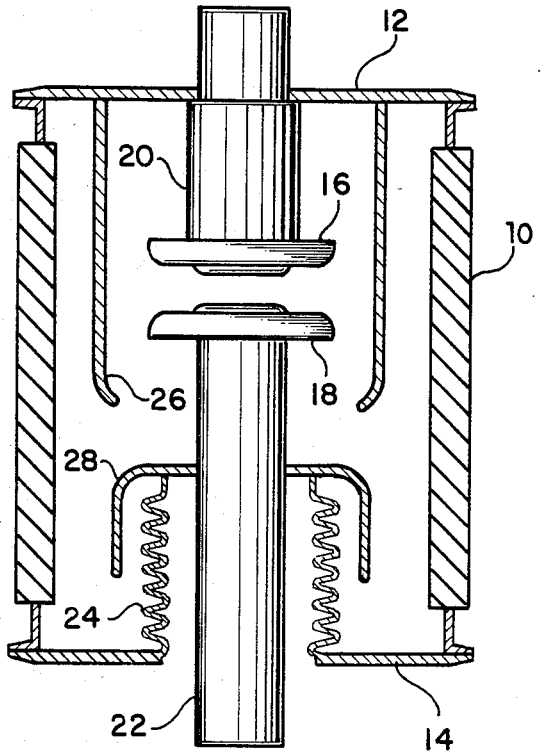
FIG. 1 is a longitudinal sectional view of a vacuum switch tube including a pair of opposite contacts or electrodes formed of one embodiment according of the electrode composition of the present invention.

Referring now to FIG. 1 of the drawing, there is illustrated a vacuum switch tube including a pair of opposite electrodes or contacts formed of one embodiment according to the electrode composition of the present invention. The arrangement comprises an evacuated electrically insulating envelope 10 in the form of a hollow cylinder including both ends closed with a pair of metallic end plates 12 and 14 respectively, and a pair of stationary and movable contacts or electrodes 16 and 18 respectively disposed in opposite relationship within the envelope 10 by having a pair of electrode rods 20 and 22 disposed on the longitudinal axis of the envelope 10 and having adjacent ends to which the electrodes 16 and 18 are brazed respectively. The electrode rod 20 includes the other end portion extended and sealed through the center of the end plate 12 while the electrode rod 22 includes the other end portion movably extended in hermetic relationship through the end plate 14 via a bellows 24. Thus the electrode rod 22 is arranged to be axially movable to engage and disengage the movable electrode 18 with and from the stationary electrode 16.

Further an intermediate metallic shield 26 in the form of a hollow cylinder is fixedly secured to the inner surface of the end plate 12 to surround the electrode rod 16, the pair of opposite electrodes 16 and 18 and that portion of the electrode rod 18 adjacent to the movable electrode 18 while another intermediate metallic shield 28 in the form of an inverted cup is fixedly secured at the bottom to the upper end surface as viewed in FIG. 1 of the bellows 28 to surround the substantial portion of the bellows 28. This measure serves to prevent the inner surface of the housing 10 and the bellows 28 from being contaminated by a vapor resulting from an electric arc occurring across the electrodes 16 and 18.

Figure 2:
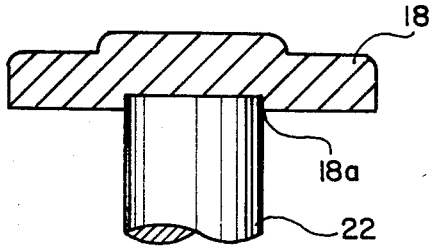
FIG. 2 is an enlarged longitudinal sectional view of the electrode connected to the end of the associated electrode rod shown in FIG. 1.

The electrodes 16 and 18 are identical in configuration to each other. FIG. 2 shows the configuration of the movable electrode 18. As shown in FIG. 2, the electrode 18 is in the form of a disc including a lower surface provided on the central portion with a recess so dimensioned that the electrode rod 22 is just fitted into the recess and an upper surface having a central flat portion raised to oppose to the recess. Then the end of the electrode rod 22 is fitted into and fixed to the recess on the lower electrode surface through a brazing agent 18*a*.

This is true in the case of the stationary electrode 16.

The electrodes 16 and 18 are composed of the electrode composition of the present invention which contemplates suppressing the harmful effect due to conventional electrode compositions including the low melting metal in a large content. More specifically the electrode composition of the present invention comprises copper (Cu), as a principal ingredient and a low melting point metal as a secondary ingredient $M_1$, in a content not exceeding 20% by weight, which metal scarcely forms a solid solution with the copper at room temperature. Added to the electrode composition is a first additional metal $M_2$ forming an alloy with the low melting point metal at a temperature not less than the melting point of the low melting point metal, alloyable with the copper at a temperature not higher than the melting point of the alloy and having a content not exceeding 10% by weight.

In order to improve the withstanding voltage and interrupting characteristics of the vacuum switch, the electrode composition may further comprise a second additional metal $M_3$ consisting of a refractory metal higher in melting point than the copper and having a content not exceeding 40% by weight.

Each of the electrodes 16 or 18 may be composed of a Cu-Bi-Te-Cr system alloy included in the Cu-$M_1$-$M_2$-$M_3$ system.

The Cu-$M_1$-$M_2$-$M_3$ system alloy can be prepared by mixing powders of the metals Cu, $M_1$, $M_2$ and $M_3$ in a predetermined composition with one another by using a ball mill, molding the resulting mixture into predetermined shapes under a pressure of three tons per cubic centimeter and sintering the molding in a furnace including an atmosphere of highly pure hydrogen at a temperature of about 1,000° C. At that time one selects such a low melting point metal that it scarcely forms a solid solution with the copper at room temperature as described above and that it also mainly serves to maintain the resulting chopping current characteristic low. Also the first additional metal $M_2$ is selected so that it is alloyed with the selected low melting point metal $M_1$ to form an alloy having higher in melting point than that metal $M_1$. For example, bismuth (Bi) and tellurium (Te) may be selected as the low melting point metal $M_1$ and the first additional metal $M_2$ respectively. This results in a Cu-Bi-Te alloy.

More specifically bismuth (Bi) having a melting point of 272° C. can form an intermetallic compound ($Bi_2Te_3$) having a melting point of 585° C. or an eutectic alloy ($TeBi_2Te_3$) having a melting point of 413° C. with tellurium (Te). Also the first additional metal $M_2$ is desirably selected to form an intermetallic compound or an eutectic alloy with the copper at a temperature not higher than the melting point of the $M_1$-$M_2$ alloy. For example, tellurium (Te) may form intermetallic compounds such as CuTe, $Cu_2Te$, $Cu_4Te_3$ etc. or eutectic alloys with copper (Cu). Thus tellurium (Te) meets the requirements taught by the present invention.

The foregoing is true in the case of the Cu-$M_1$-$M_2$ system alloys.

The second additional metal $M_3$ is high in melting point and serves to improve the withstanding voltage characteristics. It is well known that chromium (Cr) and titanium (Ti) have a getter action. Thus those elements can be expected to improve also the interrupting characteristic as a result of their ability to adsorb gases evolved upon the interruption of a current. Accordingly chromium (Cr) and titanium (Ti) are suitable examples of the second additional metal $M_3$.

In conventional processes of producing alloys of the copper-bismuth-chromium (Cu-Bi-Cr) system, the molding and sintering steps have only resulted in alloys having the metallugical structure in which clusters of aggregated bismuth particles are loosely distributed even though the step of mixing powders of copper, bismuth and chromium would have produced a mixture whatever fine, uniform dispersion it has. This is because, in the sintering step, only the bismuth having a melting point as low as 273° C. is melted at the beginning of the temperature rising stage and moreover in a temperature range of from 273° to 600° C., in which the bismuth remains low in solubility to copper, those melted portions of the bismuth readily flows into cavities which exist upon molding the mixture or before the sintering of the moldings until a large aggregate structure is formed. At temperatures in excess of 700° C., the bismuth rapidly increase in solubility to the copper and the sintering is accelerated. However, those portions of the bismuth forming solid solutions with the copper are rapidly precipitated at grain the boundaries of the copper in the cooling stage following the sintering stage effected at about 1,000° C. so that the aggregated structure is retained and more enhanced. Ultimately aggregations of the bismuth have been loosely distributed in the resulting alloy.

The tendency of the bismuth as described above is found also with lead (Pb), indium (In), lithium (Li) etc.

In the abovementioned copper-bismuth tellurium-chromium system according to the present invention, those harmful influences of the prior art practice can be efficiently eliminated as follows:

In the temperature rising stage the bismuth (Bi) and tellurium (Te) particles finely and uniformly dispersed in a mixture formed in the mixing step are dissolved in each other. Until the vicinity of 450° C., which is the melting point of the tellurium, tellurium particles themselves remain at their positions without the particles fully dissolved in the bismuth particles while increasing the amount of dissolution of the bismuth particles located in the vicinity of the tellurium particles. This prevents the flowing of dissolved or melted bismuth in a large amount which has been previously observed.

On the other hand, copper which is the principal ingredient is initiated to react on the tellurium at about 360° C. whereby the copper and tellurium are dissolved in each other. This accelerates the sintering of the principal ingredient consisting of copper. In other words, the melting and flowing is not caused because the tellurium has a high solubility in the copper at the melting point of the tellurium although the tellurium is higher in melting point than the bismuth. Moreover the tellurium and bismuth are rapidly dissolved in each other and the sintering of the tellurium proceeds without the occurrence of a large flow of the bismuth until 585° C. is reached which is the melting point of an intermetallic compound, expressed by $Bi_2Te_3$. When the temperature is further raised, the intermetallic compound ($Bi_2Te_3$) is put in its fully melted state but the sintering is completed without the formation of any aggregate structure. This is because the melted bismuth is low in fluidity and also both the bismuth and tellurium can be sufficiently dissolved in the copper in a range of such further raised temperatures.

The next succeeding cooling step only reversely pursues the sintering step as described above. Therefore the bismuth and tellurium are precipitated into fine uniform distribution while intermetallic compounds $Bi_2Te_3$, and $Cu_2Te$ or $Cu_4Te_3$, CuTe or the like or an eutectic of the bismuth and tellurium, or of the copper and tellurium are or is precipitated to be finely dispersed. At that time, the ratio of the amount of bismuth or tellurium precipitated as a simple substance to the total amount of the precipitated intermetallic compounds and eutectic alloy is determined by the ratio of tellurium to that of bismuth, the cooling rate etc. but a fine, uniform structure can be consistently produced as compared with the prior art practice.

While the present invention has been described in conjunction with bismuth and tellurium used as the secondary ingredient $M_1$ and the first additional metal $M_2$ respectively it is to be understood that the same is not restricted thereto or thereby and that it is equally applicable to other low melting point metals other than bismuth and first additional metals other than tellurium. Thus the low melting point metal comprises at least one selected from the group consisting of bismuth (Bi), lead (Pb), indium (In), lithium (Li), tin (Sn) and alloys thereof while the first additional metal comprises at least one selected from the group consisting of tellurium (Te), antimony (Sb), lanthanum (La), magnesium (Mg) and alloy thereof.

For example, an intermetallic compound ($Bi_2Te_3$) may be used as both the secondary ingredient Ml and the first additional metal $M_2$ from the beginning. Alternatively the intermetallic compound ($Bi_2Te_3$) in the form of a powder may be used as both the secondary ingredient $M_1$ and the first additional metal $M_2$.

It has been found that, by adding the second additional metal $M_3$ or the refractory metal to the electrode composition of the present invention including the principal ingredient, copper, the secondary ingredient $M_1$ and the first additional metal $M_2$ as described above, the resulting withstanding voltage and interrupting characteristics are much improved. The second additional metal $M_3$ comprises at least one refractory metal selected from the group consisting of chromium (Cr), iron (Fe), cobalt (Co), nickel (Ni), titanium (Ti), tungsten (W) and alloys thereof.

In order to demonstrate the effect of the present invention, a multitude of vacuum switch tubes as shown in FIGS. 1 and 2 were manufactured by using electrode compositions of the conventional types and those of the present invention. Those the electrode compositions were sintered into the electrodes 16 and 18 having their outside diameter of 50 millimeters and their thickness of 8 millimeters and then the sintered electrodes were cut into their shape as shown in FIG. 2. The electrodes thus cut were brazed to the associated to the respective electrode rods 20 and 22 through a brazing agent of a silver-copper (Ag-Cu) eutectic alloy within a furnance at a temperature of 800° C. Thereafter the electrodes with the electrode rods were assembled in place within respective evacuated envelopes as shown in FIG. 1 followed by heating at 600° C. for degasing the tube. This resulted in the completion of a vacuum switch tubes including the pair of sampled electrodes. Following this the vacuum switch tubes were operatively combined with associated vacuum switches and then subjected to various tests for the purpose of comparing the performances with one another. The results of the tests are indicated in the following TABLE:

TABLE

| | COMPOSITION IN % BY WEIGHT | TEST 1 CHOPG. CUR. IN A. AFT. 10,000 SWTG. AT 500A | TEST 2 INTERR. CUR. IN kA AT 2-5.4 kV | TEST 3 WITHSTANDG. VOLT. IN kV | TEST 4 BRAZG. STR. IN kg/mm$^2$ |
|---|---|---|---|---|---|
| PRIOR ART I | 80Cu—20Bi | 2.1 | 8 | 25-30 | UP TO 3 |
| PRIOR ART II | 80Cu—15Bi—5Pb | 2.5 | 6 | 20-25 | UP TO 1 |
| PRIOR ART III | 55Cu—25Cr—20Bi | 1.7 | 8 | 30-35 | UP TO 2 |
| INVENTION I | 80Cu—15Bi—5Te | 1.0 | 10 | 35-45 | 3-6 |
| INVENTION II | 52Cu—13Bi—7$Bi_2Te_3$—3TiTe—25Cr | 0.85 | 16 | 35-40 | 4-8 |
| INVENTION III | 60Cu—17$Bi_2Te_3$—3TiTe—20Cr | 1.1 | 14 | 40-45 | 4-9 |
| INVENTION IV | 59.5Cu—15Bi—5Te—0.5Ti—20Cr | 0.9 | 16 | 45-50 | 3-8 |
| INVENTION V | 65Cu—10Pb—7$Bi_2Te_3$—3TiTe—15Cr | 1.2 | 12 | 35-40 | 3-7 |
| INVENTION VI | 62Cu—15Bi—5$Bi_2Te_3$—3TiTe—15Co | 1.0 | 12 | 40-45 | 5-7 |

In the above TABLE "PRIOR ART I", "PRIOR ART II" and "PRIOR ART III" in the leftmost column designate three examples of the prior art practice including the electrodes formed respectively of different types of conventional electrode composition as shown in a column at the right of the leftmost column headed with "COMPOSITION". Similarly "INVENTION I" through "INVENTION VI" designate six examples of the present invention. In the example designated by "INVENTION I" the electrodes were formed of the electrode composition of the present invention comprising, by weight, 80% of copper (Cu), 15% of bismuth (Bi) and 5% of tellurium (Te) to form the Cu-$M_1$-$M_2$ system. In the example designated by "INVENTION II" the electrodes were formed of the Cu-$M_1$-$M_2$-$M_3$ system electrode composition of the present invention comprising by weight, 52% of copper (Cu), 13% of bismuth (Bi), 7% of $Bi_2Te_3$, 3% of TiTe and 25% of chromium (Cr). The example designated by "INVENTION III" included the Cu-$Mi_1$-$M_2$-$M_3$ system electrode composition of the present invention comprising, by weight, 60% of copper (Cu), 17% of $Bi_2Te_3$, 3% of TiTe, and 20% of chromium (Cr). The example designated by "INVENTION IV" included the Cu-$M_1$-$M_2$-$M_3$ system electrode composition of the present invention comprising, by weight, 59.5% of copper (Cu), 15% of bismuth (Bi), 5% of tellurium (Te), 0.5% of titanium (Ti) and 20% chromium (Cr). The example designated by "INVENTION V" included the Cu-$M_1$-$M_2$-$M_3$ system electrode composition of the present invention comprising, by weight, 65% of copper (Cu), 10% of lead (Pb), 7% of $Bi_2Te_3$, 3% of TiTe and 15% of chromium (Cr). In the example designated by "INVENTION VI" the electrodes were formed of the Cu-$M_1$-$M_2$-$M_3$ system electrode composition of the present invention comprising, by weight, 62% of copper (Cu), 15% of bismuth (Bi), 5% of $Bi_2Te_3$, 3% of TiTe and 15% of cobalt (Co). Those electrode compositions of the present invention are shown in the column "COMPOSITION" in the same rows as the associated examples of the present invention.

The chopping current characteristic was expressed by the mean value of chopping currents occurring when each of the examples interrupted a resistance circuit having flowing therethrough an alternating current with the peak value of 20 amperes. Immediately after each of the examples had been completed, the measured chopping currents were as low as from 0.2 to 0.4 ampere. This is because the low melting point metal oozes out on the surface of the associated electrode in the brazing step and/or the heat degasing step.

After each example had switched a circuit having a load current of 500 amperes 10,000 times, the chopping currents were measured 100 times and the mean value thereof was calculated. The mean values thus calculated one for each of the tested vacuum switch tubes are denoted in the column headed with "TEST 1" in the same rows as the associated examples.

From the column "TEST 1" it is seen that in each of the examples of the present invention the mean value is of one ampere or thereabout whereas, in the prior art type examples the mean values reach two amperes or thereabout. This is because, the electrode compositions used with the prior art type examples have the structure in which aggregate clusters of the low melting metal are loosely distributed. Thus the low melting point metal is selectively vaporized and scattered upon the opening and closure of the associated electrodes until copper blanks forming no solid solution with the low melting point metal are exposed to the surface of the electrode. It is well known that copper has a chopping current ranging from 5 to 10 amperes. Thus if there is a chance of breaking an electric arc by the copper blank then the mean value of the chopping currents is forced up.

In contrast the electrode composition of the present invention has the mean value of chopping currents capable of being maintained low for the following reasons: Since particles of the low melting metal are put in an immensity of fine uniform distributions but not in loose distributions, there is only a very small chance of breaking an electric arc by a copper blank as described above. In addition the low melting metal is left in eutectic or mixed state in the copper matrix. Thus even if the electric arc would be broken by a copper blank by any possibility, the particular chopping current is not so increased.

Also the examples were used to interrupt a shorted circuit with an electrode generator. In this case the circuit was successively applied with voltages slowly increased so as to cause a current to flow therethrough with incremental magnitudes of 2 kiloamperes. In this way the maximum interrupting current was measured in a range of voltages of from 2 to 5.4 kilovolts. The results of the measurements are shown in a column headed with "TEST 2" in the same rows as the associated examples.

As shown in the column "TEST 2", the conventional examples have the maximum interrupting currents ranging from 6 to 8 kiloamperes. This is because when the electrodes are exposed to an electric arc having a high current, the aggregated structures of the low melting point metal within the electrode are locally and extraordinarily vaporized resulting in the deterioration of the insulation recovery characteristic.

On the other hand, the examples of the present invention exhibited the maximum interrupting current ranging from 10 to 16 kiloamperes which figures were higher than those obtained with the conventional examples. As described above, the electrode of the present invention includes the aggregate structures of low melting point metal finely and uniformly distributed thereinto. This suppresses the extraordinary vaporization of the low melting point metal which would adversely affect the aggregated structures thereof. In addition, the low melting point metal was alloyed with the first additional metal. Thus the resulting alloy suppresses the extraordinary vaporization of the low melting point metal to a low extent.

Subsequently after having interrupted currents of 500 amperes 200 times, each of the examples was applied with an inpulse voltage having a duration of $1\times40$ micro-seconds three times with incremental voltages of 5 kilovolts to measure withstanding voltages. The measurement of the lower limit of the withstanding voltage was determined by that applied voltage at which an electrical insulation between the pair of opposite electrodes of each example was broken down even with a single application of such a voltage and the upper limit thereof was determined by that applied voltage at which the electrical insulation between the opposite electrodes of each example was broken down with all the three applications of such voltage.

The results of the measurements are similarly indicated in a column headed with "TEST 3". In that column figures on the left hand and right hand sides indicate the lower and upper limits of the withstanding voltage. From the column "TEST 3" it is seen that the present invention is superior in withstanding voltage to the prior art practice. This appears to be attributed to both the aggregate structures of the low melting point metal as described above and the alleviation of contamination of the inner housing surface.

After the completion of the three tests as described above, the three vacuum switch tubes of each example were dismantled. Then the electrode 18 and the electrode rod 22 brazed thereto were subjected to the tension test by using an Amster tension tester whereby a strength of the brazed joint was measured.

The results of the measurements were shown in the rightmost column headed with "TEST 4". In some of the conventional examples the electrode disengaged from the associated electrode rod as soon as the connected electrode rod and electrode disposed on a tensioning jig were initiated to be applied with a tensile force. Some of the conventional examples could hardly withstand a tensile force of not higher than 3 kilograms per square millimeter as shown in the column "TEST 4". Therefore it has been concluded that the prior art type examples can not be used with the arrangement shown in FIG. 2 as the vacuum switch.

While the examples were tested according to "TEST 1" by using a vacuum switch applying a fairly low impulse thereto, the electrodes in some of the conventional examples might disengage from the associated electrode rods during the test. An X-ray microanalyser was used to analyze the composition of metallugical structure of the brazed layers from which the electrodes disengaged. From the result of the analysis it has been found that the greater part of silver (Ag) included in the silver-copper (Ag-Cu) brazing agent has been diffused into the interior of the electrode and instead the low melting point metal oozes out in the brazed layer to form a layer therein with the result the electrode has disengaged from that layer.

On the other hand, it is true that even in the examples of the present invention the electrode is still jointed to an associated electrode with a brazing strength less than one half that inherently provided by silver-copper brazing agent in view of the latter brazing strength. However the electrode has a strength fitted for practical use. In the rightmost column of the TABLE the examples of the present invention are shown as having a brazing strength ranging from 3 to 9 kilograms per square millimeter.

Finally experiments have been conducted to determine contents of ingredients composing the electrode composition of the present invention. The results of the experiments has indicated that, when the electrode composition has added thereto the secondary ingredient $M_1$ or the low melting point metal in a content exceeding 20% by weight, the resulting alloy itself has a mechanical strength unsuited for practical use. On the other hand the addition of the first additional metal $M_2$ in a content exceeding 10% by weight causes an excessive increase in its solubility to the copper which forms the principal ingredient resulting in a great decrease in electric conductivity of the produced electrode composition. Thus the interrupting performance is deteriorated and a contact resistance increases. As a result, the contents of the secondary ingredient $M_1$ and first additional metal $M_2$ should not exceed 20% and 10% by weight respectively. Also, in order that the satisfactory withstanding voltage and interrupting characteristics can be expected, the content of the second additional metal or refractory metal should be less than 40% by weight. This is because the resulting alloy itself decreases in electric conductivity.

In summary the present invention provides an electrode composition for a vacuum switch comprising copper forming a principal ingredient, a secondary ingredient scarcely forming a solid solution with the copper at room temperature and exhibiting the effect of decreasing a chopping current, and an additional metal alloyed with the secondary ingredient to form an alloy having a melting point higher than that of the secondary ingredient and still dissolved in the copper. Thus the secondary ingredient is finely and uniformly dispersed into the electrode composition and the resulting electrode is low in chopping current and improved in interrupting and withstanding voltage characteristics. In order to further improve the withstanding voltage and interrupting characteristics, the electrode composition may include a refractory metal higher in melting point than the copper. In addition, the latter electrode composition is excellent is brazing strength with which the resulting electrode is attached to an associated electrode rod through a brazing agent of a silver-copper alloy.

While the present invention has been described in conjunction with a few preferred embodiments thereof it is to be understood that numerous changes and modifications may be resorted to without departing from the spirit and scope of the present invention.

What we claim is:

1. An electrode for a vacuum switch, said electrode being produced by subjecting a composition consisting essentially of:

(a) not more than 20% by weight of at least one low melting point metal selected from the group consisting of bismuth (Bi), lead (Pb), indium (In), lithium (Li), tin (Sn) and alloys thereof;

(b) not more than 10% by weight of a metal capable of forming an alloy with said low melting point metal at a temperature not less than the melting point of said low melting point metal, and being alloyable with copper at a temperature not higher than the melting point of said alloy, selected from the group consisting of tellurium (Te), antimony (Sb), lanthanum (La), magnesium (Mg) and alloys thereof; and (c) the balance being copper (Cu)

to a powder metallurgical technique which comprises mixing components (a), (b) and (c) in powder form, molding the resultant mixture into a predetermined electrode shape and sintering the resultant shape in a furnace at a temperature not higher than the melting point of copper in an atmosphere of substantially pure hydrogen.

2. The electrode for a vacuum switch according to claim 1 which additionally contains less than 40% by weight of at least one refractory metal powder selected from the group consisting of chromium (Cr), iron (Fe), cobalt (Co), nickel (Ni), titanium (Ti), tungsten (W) and alloys thereof.

* * * * *